US007824160B2

(12) United States Patent
Nakamura et al.

(10) Patent No.: US 7,824,160 B2
(45) Date of Patent: Nov. 2, 2010

(54) SCROLL COMPRESSOR AND REFRIGERATING APPARATUS

(75) Inventors: Satoshi Nakamura, Shizuoka (JP); Mutsunori Matsunaga, Shizuoka (JP); Shuji Hasegawa, Shizuoka (JP); Kenji Tojo, Moriya (JP)

(73) Assignee: Hitachi Appliances, Inc., Tokyo (JP)

( * ) Notice: Subject to any disclaimer, the term of this patent is extended or adjusted under 35 U.S.C. 154(b) by 613 days.

(21) Appl. No.: 11/448,045

(22) Filed: Jun. 7, 2006

(65) Prior Publication Data

US 2006/0277931 A1 Dec. 14, 2006

(30) Foreign Application Priority Data

Jun. 10, 2005 (JP) ..... 2005-170278

(51) Int. Cl.
*F04B 49/00* (2006.01)

(52) U.S. Cl. ..... 417/213; 417/279; 417/410.5; 62/505

(58) Field of Classification Search ..... 417/213, 417/279, 410.5; 62/505; 418/97, 55.5
See application file for complete search history.

(56) References Cited

U.S. PATENT DOCUMENTS 5,103,652 A * 4/1992 Mizuno et al. ..... 62/505
5,469,716 A * 11/1995 Bass et al. ..... 62/505
5,722,257 A * 3/1998 Ishii et al. ..... 62/505

FOREIGN PATENT DOCUMENTS

JP 05-302760 11/1993
JP 09-229496 9/1997

* cited by examiner

*Primary Examiner*—Devon C Kramer
*Assistant Examiner*—Todd D Jacobs
(74) *Attorney, Agent, or Firm*—Antonelli, Terry, Stout & Kraus, LLP.

(57) ABSTRACT

A scroll back pressure chamber in a scroll compressor is composed of a space 111 filled with suction pressure (or intermediate pressure) and a space filled with discharge pressure, and the summation of the suction pressure (or the intermediate pressure) and the discharge pressure presses one of scrolls against the other of the scrolls. An injection hole, through which refrigerant in gas state or refrigerant in liquid state is injected into a compression chamber of the scroll compressor, is provided on a fixed scroll, and the gas refrigerant injection or the liquid refrigerant injection is selected and carried out according to an operating pressure ratio.

16 Claims, 8 Drawing Sheets

GAS AND LIQUID INJECTION CONTROL FLOWCHART

CYCLE SYSTEM DIAGRAM (GAS AND LIQUID INJECTION)
EXAMPLE OF USE OF SUB-COOLER

CYCLE SYSTEM DIAGRAM (GAS AND LIQUID INJECTION)
EXAMPLE OF USE OF GAS-LIQUID SEPARATOR

GAS AND LIQUID INJECTION CONTROL FLOWCHART

SCROLL COMPRESSOR AND REFRIGERATING APPARATUS

INCORPORATION BY REFERENCE

The present application claims priority from Japanese application JP 2005-170278 filed on Jun. 10, 2005, the content of which is hereby incorporated by reference into this application.

BACKGROUND OF THE INVENTION

The present invention relates to a scroll compressor comprising a scroll compression mechanism including a fixed scroll and an orbiting scroll and constructed such that a back pressure chamber filled with a gas refrigerant is provided on a back surface of an end plate at least one of the scrolls and a gas refrigerant pressure in the back pressure chamber presses one of the scrolls against the other of the scrolls, and a refrigerating apparatus.

There is known a scroll compressor comprising a compression mechanism including a fixed scroll, an orbiting scroll, etc. and a drive unit that drives the compression mechanism, wherein the compression mechanism and the drive unit are received in a closed vessel, and such compressor is frequently used in a refrigerating cycle composed of a condenser, an expansion valve, an evaporator, etc. Further, there is known a technology in a refrigerating cycle constructed in such a manner, in which a gas refrigerant downstream of the condenser is injected into the compression chamber to increase a difference in enthalpy across the evaporator to increase a refrigerating capacity, thus improving COP of the refrigerating cycle.

On the other hand, in compressors for refrigeration or cold storage, in which operation at a high pressure ratio is required, or compressors for an air conditioner for cold districts, in which, at the time of heating, operation at a high pressure ratio is required, include one, in which a liquid refrigerant of low temperature on an upstream side of an expansion valve is injected into the compression chamber to decrease discharge gas temperature, thereby suppressing an increase in temperature of a motor winding to enlarge an operating range.

Further, there is known a compressor, in which gas injection and liquid injection are used in the same compressor at need to enable improving COP of a refrigerating cycle and enlarging an operating range.

Scroll compressors constructed such that a back pressure chamber filled with a gas refrigerant is provided on a back surface of a scroll and a gas refrigerant pressure in the back pressure chamber presses one of the scrolls against the other of the scrolls, include one, in which a back pressure chamber is composed of a space filled with suction gas or gas of an intermediate pressure, and a space filled with gas of discharge pressure. In such scroll compressor, the summation of suction gas pressure or intermediate pressure and discharge gas pressure presses one of scrolls against the other of the scrolls, so that the summation of refrigerant gas pressure in the back pressure chamber becomes large under that operating condition of high pressure ratio, in which the discharge gas pressure is high and the suction gas pressure is low.

It is assumed that Ps indicates pressure in the back pressure chamber when the back pressure chamber is put at the suction gas pressure, or Pb indicates pressure in the back pressure chamber when the back pressure chamber is put at the intermediate pressure, and S1 indicates an area of an end plate of a scroll, which bears these pressures. Further, assuming that S2 indicates an area of an end plate of a scroll, which bears a gas pressure of the back pressure chamber filled with discharge gas pressure Pd, a force F1 pressing that scroll, on which refrigerant gas pressure of the back pressure chamber acts, against another scroll is represented by the following formula (1) or (2).

$$F1=Ps\cdot S1+Pd\cdot S2 \quad (1)$$

$$F2=Pb\cdot S1+Pd\cdot S2 \quad (2)$$

It is found in the formula (1) that F1 increases and a magnitude thereof is governed by the discharge gas pressure under that operating condition of a high pressure ratio, in which the discharge gas pressure Pd is high and the suction gas pressure Ps is low. Also, since the intermediate pressure Pb becomes also small when the suction gas pressure Ps is small, it is also found in the formula (2) that F1 increases and a magnitude thereof is governed by the discharge gas pressure under that operating condition of a high pressure ratio, in which the discharge gas pressure Pd is high and the suction gas pressure Ps is low. In particular, since a pressure bearing area S2, on which the discharge gas pressure Pd acts, tends to increase in the back pressure chamber, in which a sealing material seals a space filled with suction gas or gas of intermediate pressure, and a space filled with gas of discharge pressure, a pressing force F1 is governed by the discharge gas pressure Pd and becomes hard to be influenced by the suction gas pressure Ps and the intermediate pressure Pb.

On the other hand, a force F2 generated by an internal pressure in a compression chamber, which is defined by a fixed scroll and an orbiting scroll, acts in a reverse direction to the pressing force F1. Assuming that compression process comprises an adiabatic change with a polytropic exponent k being constant, internal pressure P in the compression chamber is represented from the relationship $pV^K$=constant by the following formula (3)

$$P=(V\max/V)^k\cdot Ps \quad (3)$$

where V indicates a volume of the compression chamber and Vmax indicates a maximum confined volume just after confinement is started.

Further, assuming that Smin indicates a pressure bearing area of the compression chamber, on which the discharge pressure just after termination of compression acts, a force F2 generated by the internal pressure is represented by the formula (4)

$$F2=\int Pds+Pd\cdot S\min=Ps\cdot V\max^k\int(1/V^k)ds+Pd\cdot S\min \quad (4)$$

It is found from the formula (4) that the force (separating force) F2 generated by the internal pressure becomes small since a value of a first term in the formula (4) becomes small when the suction gas pressure Ps becomes small.

A net force F3 pressing one of scrolls against the other of the scrolls becomes a difference (F3=F1−F2) between the pressing force F1 by pressure in the back pressure chamber and the separating force F2 generated by the internal pressure, and this relationship is shown in FIG. 2. It is seen from FIG. 2 that a net force F3 pressing that scroll, on which the refrigerant gas pressure of the back pressure chamber acts, against the other of the scrolls becomes excessively large under that operating condition of a high pressure ratio, in which the discharge gas pressure Pd is high and the suction gas pressure Ps is low. Therefore, there is caused a problem that, under the operating condition of a high pressure ratio, a contact surface pressure at tip ends of the scrolls becomes excessively large, and wear and galling are generated on the tip ends of the scrolls.

SUMMARY OF THE INVENTION

It is an object of the invention to provide a scroll compressor, in which generation of wear and galling at tip ends of scrolls can be reduced and an operating range can be enlarged by enabling further decreasing a pressing force, with which one of scrolls is pressed against the other of the scrolls, and a refrigerating apparatus.

The invention provides a scroll compressor comprising a compression mechanism composed of a fixed scroll, an orbiting scroll, etc., and a drive unit that drives the compression mechanism, wherein the compression mechanism and the drive unit are accommodated in a closed vessel, one of the scrolls is provided on a back surface thereof with a back pressure chamber filled with gas refrigerant, the one of the scrolls is pressed against the other of the scrolls by gas refrigerant pressure in the back pressure chamber, the scroll compressor is used in a refrigerating cycle, which includes a condenser and an evaporator, and wherein the back pressure chamber is composed of a space of suction pressure and a space of discharge pressure, the summation of the suction pressure and the discharge pressure presses the one of the scrolls against the other of the scrolls, a compression chamber defined by the fixed scroll and the orbiting scroll is constructed to enable injection of both of gas refrigerant and liquid refrigerant there into from downstream of the condenser of the refrigerating cycle, and gas injection is implemented when a ratio (Pd/Ps) of pressure Ps of suction refrigerant into the compressor and pressure Pd of discharge refrigerant is larger than a set volume ratio of the compressor and smaller than an optional set value, which is larger than the set volume ratio, and liquid injection is implemented when the ratio is larger than the optional set value.

An injection hole for injecting the gas refrigerant or the liquid refrigerant into the compression chamber of the scroll compressor is preferably formed on the fixed scroll. Further, a sealing material preferably seals the space of the suction pressure and the space of the discharge pressure in the back pressure chamber.

The invention provides a scroll compressor comprising a compression mechanism composed of a fixed scroll, an orbiting scroll, etc., and a drive unit that drives the compression mechanism, wherein the compression mechanism and the drive unit are accommodated in a closed vessel, one of the scrolls is provided on a back surface thereof with a back pressure chamber filled with as refrigerant, the one of the scrolls is pressed against the other of the scrolls by gas refrigerant pressure in the back pressure chamber, the scroll compressor is used in a refrigerating cycle, which includes a condenser and an evaporator, and wherein the back pressure chamber is composed of a space filled with pressure intermediate between discharge pressure and suction pressure and a space filled with the discharge pressure, the summation of the intermediate pressure and the discharge pressure presses the one of the scrolls against the other of the scrolls, a compression chamber defined by the fixed scroll and the orbiting scroll is constructed to enable injection of both of gas refrigerant and liquid refrigerant there into from downstream of the condenser of the refrigerating cycle, and gas injection is implemented when a ratio (Pd/Ps) of pressure Ps of suction refrigerant into the compressor and pressure Pd of discharge refrigerant is larger than a set volume ratio of the compressor and smaller than an optional set value, which is larger than the set volume ratio, and liquid injection is implemented when the ratio is larger than the optional set value.

Preferably, an intermediate pressure hole, which provides communication between the back pressure chamber space of the intermediate pressure and the compression chamber, is provided on an end plate of the scroll, on which pressure of the back pressure chamber acts, and an injection hole, through which the gas refrigerant or the liquid refrigerant is injected into the compression chamber, is formed on the end plate of the fixed scroll.

Preferably, the injection hole is formed so as to be communicated to a compression chamber on a higher pressure side than that of the compression chamber, to which the intermediate pressure hole is communicated, and the intermediate pressure hole and the injection hole are formed so that an area, in which the intermediate pressure hole is opened to the compression chamber, and an area, in which the injection hole is opened to the compression chamber, do not overlap each other. Further, preferably, the injection hole is provided in a position not communicated to an discharge space of the compressor, that is, in a position, in which the compression chamber, to which the injection hole is opened, does not become the discharge pressure, and the intermediate pressure hole is provided in a position not communicated to an suction space of the compressor, that is, in a position, in which the compression chamber, to which the intermediate pressure hole is opened, does not become the suction pressure.

In this manner, by preventing the area, in which the intermediate pressure hole is opened to the compression chamber, and the area, in which the injection hole is opened to the compression chamber, from overlapping each other, arranging the injection hole in a position not communicated to the discharge space of the compressor, and arranging the intermediate pressure hole in a position not communicated to the suction space of the compressor, it is possible to reduce influences of the intermediate pressure on the back pressure chamber in case of gas injection and liquid injection, thus enabling stabilizing the behavior of the orbiting scroll.

With the above arrangement, a sealing material preferably seals the space of the intermediate pressure and the space of the discharge pressure in the back pressure chamber, and an area ratio S1/S2 of an area S1 of the end plate of the scroll, which bears the suction pressure or the intermediate pressure in the back pressure chamber, and an area S2 of an end plate of the scroll, which bears the discharge pressure, is preferably less than 5.

In addition, control is preferably implemented so that the gas refrigerant or the liquid refrigerant is injected into the compression chamber when there stands an operating condition, in which a ratio (Pd/Ps) of the pressure Ps of the suction refrigerant and the pressure Pd of the discharge refrigerant exceeds 3, and injection is not performed when the ratio is equal to or less than 3. Further, preferably, a ratio (Pd/Ps) of the pressure Ps of the suction refrigerant and the pressure Pd of the discharge refrigerant is 3 to 8, gas injection is carried out, and the liquid refrigerant is injected into the compression chamber under an operating condition, in which the ratio exceeds 8.

The invention provides a refrigerating apparatus comprising a compressor, a condenser, a sub-cooler, and an injection pipe branching from a refrigerant pipe between the condenser and the sub-cooler, the injection pipe extending via the sub-cooler to be connected to a compression chamber in the compressor, and wherein the injection pipe is provided with throttle means (expansion valve) A on an upstream side of the sub-cooler and throttle means (expansion valve) B on a downstream side of the sub-cooler, in case of gas injection into the compressor, the throttle means A is decreased in opening degree and the throttle means B is made larger (preferably, fully opened) in opening degree than the throttle means A, and in case of liquid injection, the throttle means B is decreased in opening degree and the throttle means A is made larger (preferably, fully opened) in opening degree than the throttle means B.

The invention provides a refrigerating apparatus provided with a compressor, a condenser, and a gas-liquid separator, and comprising a liquid injection system (piping) communicated to a liquid reservoir in a lower region within the gas-liquid separator and to a compression chamber of the compressor and provided with throttle means (expansion valve) F, a gas injection system communicated to a gas space in an upper region within the gas-liquid separator and to the compression chamber of the compressor and provided with throttle means (expansion valve) E, and wherein in case of liquid injection into the compressor, the liquid injection system is used, and in case of gas injection into the compressor, the gas injection system is used to inject a refrigerant into the compression chamber.

In case of liquid injection into the compressor, control is implemented such that the throttle means F is decreased in opening degree and the throttle means E is made further smaller in opening degree than the throttle means F, and in case of gas injection, control is implemented such that the throttle means E is decreased in opening degree and the throttle means F is made further smaller in opening degree than the throttle means E, whereby respective injections can be carried out.

In addition, preferably, the compressor in the above-described refrigerating apparatus is a scroll compressor comprising a compression mechanism composed of a fixed scroll, an orbiting scroll, etc., and a drive unit that drives the compression mechanism, wherein the compression mechanism and the drive unit are accommodated in a closed vessel, one of the scrolls is provided on a back surface thereof with a back pressure chamber, the one of the scrolls is pressed against the other of the scrolls by a pressure in the back pressure chamber, the back pressure chamber is composed of a space of discharge pressure and a low pressure space (space of suction pressure or intermediate pressure) of lower pressure than that of the former space, the summation of suction pressure and discharge pressure presses the one of the scrolls against the other of the scrolls, and the compressor further comprising control means that controls respective throttle means provided on an injection line so that gas injection is carried out when a ratio (Pd/Ps) of pressure Ps of an suction refrigerant into the compressor and pressure Pd of a discharge refrigerant is larger than a set volume ratio of the compressor and smaller than an optional set value, which is larger than the set volume ratio, and liquid injection is carried out in the case where the ratio is larger than the optional set value.

According to the invention, both of the gas refrigerant and the liquid refrigerant can be injected into the compression chamber from downstream of the condenser of the refrigerating cycle, and gas injection or liquid injection can be selected and carried out according to an operating condition of the compressor, so that it becomes possible to further decrease a pressing force, with which one of scrolls in a scroll compressor is pressed against the other of the scrolls, thus enabling reducing generation of wear and galling at tip ends of the scrolls and also enlarging an operating range.

Further, by arranging a position of the injection hole and a position of the intermediate pressure hole so as to prevent interference there between, it is possible to stabilize an orbiting scroll in behavior even under an operating condition, in which one of gas injection and liquid injection is used, whereby it is possible to obtain a compressor, which is improved in volume efficiency and small in vibration and noise.

Other objects, features and advantages of the invention will become apparent from the following description of the embodiments of the invention taken in conjunction with the accompanying drawings.

DESCRIPTION OF THE PREFERRED EMBODIMENTS

Embodiments of the invention will be described hereinafter.

A scroll compressor according to the invention comprises a back pressure chamber provided on a back surface of an orbiting scroll or a fixed scroll and filled with gas refrigerant, and is constructed such that gas refrigerant pressure in the back pressure chamber presses one of the scrolls against the other of the scrolls. Further, the back pressure chamber is composed of a low pressure side space filled with suction gas or gas of intermediate pressure, and a high pressure side space filled with discharge gas, and one of the scrolls is pressed against the other of the scrolls by the summation of suction gas pressure or intermediate pressure and discharge gas pressure. Further, according to the invention, an injection hole is provided on the fixed scroll so that a gas refrigerant or a liquid refrigerant can be injected into a compression chamber, which is defined by the orbiting scroll and the fixed scroll.

Figure 10:
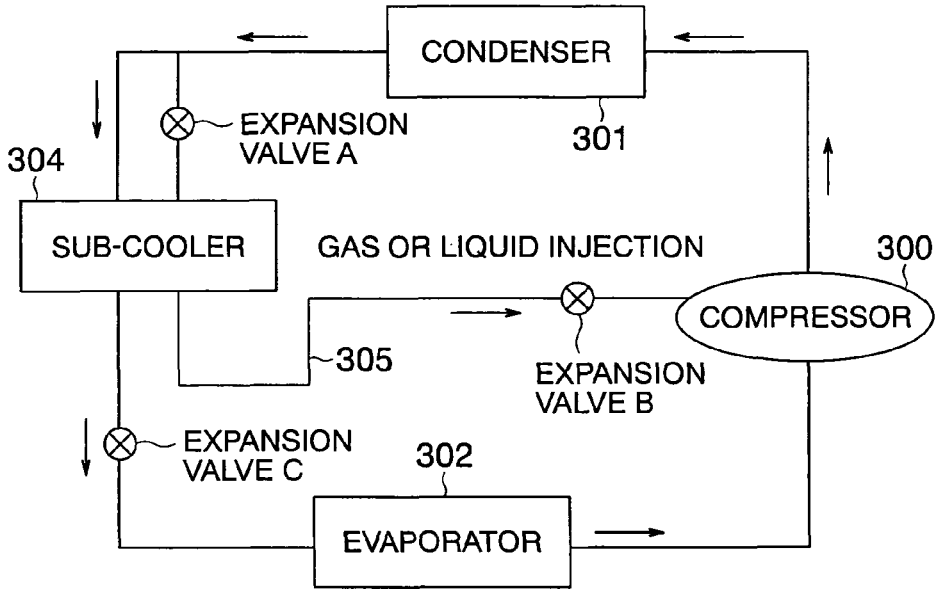
FIG. 10 is a view showing a construction of a refrigerating cycle exemplifying a refrigerating apparatus according to the invention.

With reference to FIG. 10, an example of a refrigerating apparatus (refrigerating cycle), in which one of the gas refrigerant or the liquid refrigerant is selected at need and can be injected into a compression chamber of a scroll compressor will be described.

In FIG. 10, the refrigerating cycle is constituted by connecting a compressor 300, a condenser 301, a sub-cooler 304, an expansion valve C, an evaporator 302, etc. in succession by means of piping. An injection pipe 305 branches from a refrigerant pipe between the condenser 301 and the sub-cooler 304, and the injection pipe extends via the sub-cooler 304 to be connected to a compression chamber in the course of compression in the compressor 300. The sub-cooler 304 is constructed to enable heat exchange between refrigerant flowing through a main refrigerant pipe and refrigerant flowing through the injection pipe. An expansion valve A is provided on the injection pipe upstream of the sub-cooler and an expansion valve B is provided on the injection pipe downstream of the sub-cooler, and the expansion valves are composed of an electronic expansion valve capable of flow regulation, etc.

In the case where the gas refrigerant is to be injected into the compressor, the gas refrigerant evaporated by the sub-cooler can be injected into the compression chamber by decreasing an opening degree of the expansion valve A and making an opening degree of the expansion valve B larger than that of the expansion valve A, preferably, fully open. In this case, it is possible to regulate a flow rate of the gas refrigerant which is injected according to a magnitude of an opening degree of the expansion valve A.

In the case where the liquid refrigerant is to be injected, liquid injection into the compression chamber is made possible by making an opening degree of the expansion valve A large, preferably, fully open and making an opening degree of the expansion valve B smaller than that of the expansion valve A to throttle the same. In this case, since the liquid refrigerant is not varied in physical properties across the expansion valve A, the liquid refrigerant at discharge pressure is present this side of the expansion valve B, so that it becomes possible to regulate a flow rate of the liquid injection according to a magnitude of an opening degree of the expansion valve B to carry out the liquid injection into the compression chamber.

In addition, in the case where neither of the gas injection and the liquid injection is carried out, it suffices to fully close the expansion valve A and the expansion valve B.

Figure 11:
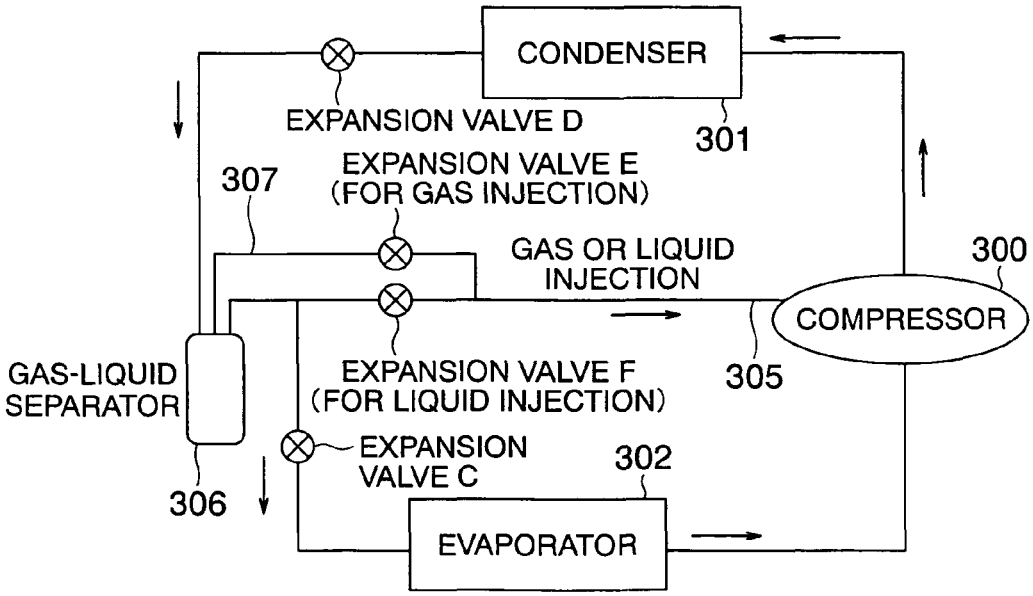
FIG. 11 is a view showing a construction of a refrigerating cycle exemplifying a further refrigerating apparatus according to the invention.

FIG. 11 shows a further example of a refrigerating apparatus according to the invention, and the example is applied to a refrigerating cycle including a gas-liquid separator 306. The refrigerating cycle is constituted by connecting a compressor 300, a condenser 301, a gas-liquid separator 306, an evaporator 302, an expansion valve C, etc. in succession by means of piping. A main refrigerant pipe including the expansion valve C is led out of a liquid phase in a lower region within the gas-liquid separator 306, and an injection pipe 305 branches from the main refrigerant pipe between the gas-liquid separator 306 and the expansion valve C to be connected to a compression chamber in the compressor 300. An expansion valve F for liquid injection is provided on the injection pipe, and the injection pipe downstream of the expansion valve F and an upper space in the gas-liquid separator 306 are connected to each other by a bypass pipe 307. The bypass pipe 307 is also provided with an expansion valve E.

In addition, while the injection pipe 305 branches from the main refrigerant pipe in this example, one end of the injection pipe 305 may be communicated to a liquid phase in a lower region within the gas-liquid separator 306. Further, while the expansion valves E, F preferably comprise an electronic expansion valve capable of flow regulation, they can comprise a combination of an electromagnetic valve (opening and closing valve) and a capillary instead.

In the example shown in FIG. 11, in the case where the gas refrigerant is to be injected into the compressor, the gas refrigerant separated by the gas-liquid separator 306 can be injected into the compression chamber via the bypass pipe 307 and the injection pipe 305 by increasing an opening degree of the expansion valve E and fully closing the expansion valve F or making an opening degree thereof smaller than that of the expansion valve E. In this case, it becomes possible to regulate a flow rate of the gas refrigerant by regulating an opening degree of the expansion valve E.

In the case where liquid injection is to be carried out, a part of the liquid refrigerant separated by the gas-liquid separator and flowing through the main refrigerant pipe can be injected into the compression chamber via the expansion valve F from the injection pipe 305 by fully closing the expansion valve E or decreasing an opening degree thereof and making an opening degree of the expansion valve F larger than that of the expansion valve E. Also in this case, it becomes possible to regulate an amount of liquid injection by regulating an opening degree of the expansion valve F.

In addition, in the case where neither of the gas injection and the liquid injection is carried out, it suffices to fully close both the expansion valves E and F.

The refrigerating apparatus shown in FIG. 10 or FIG. 11 is provided with a controller (not shown), which controls opening and closing of the respective expansion valves A to F, or opening degrees thereof.

By using the refrigerating apparatus described above to inject the gas refrigerant or the liquid refrigerant into the compression chamber, the compression chamber is increased in pressure and a force F2 generated by internal pressure in the compression chamber is increased to make a force F2'. Consequently, also under the condition of a high pressure ratio, in which the discharge gas pressure Pd is high and the suction gas pressure Ps is low, a net pressing force F3, by which one of scrolls is pressed against the other of the scrolls, becomes F3=F1−F2' and can be made small as compared with the case where no injection is carried out.

Figure 2:
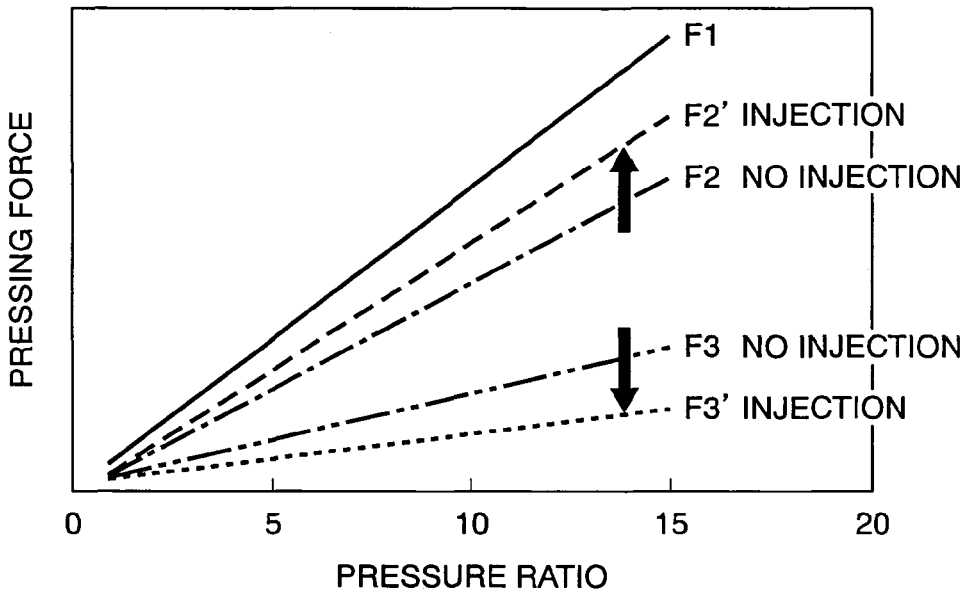
FIG. 2 is a diagram illustrating the relationship between an operating condition (pressure ratio) and a pressing force in an embodiment of the invention.

More specifically, as shown in FIG. 2, since a separating force generated by internal pressure in the compression chamber is increased to F2' from F2, it is possible to decrease the net pressing force from F3 to F3' as shown in FIG. 2. Thereby, it is possible to decrease a contact surface pressure between tip ends of the scrolls and end plates of the scrolls, thus suppressing generation of wear and galling on the scroll tip ends and the scroll end plates to enable realizing a scroll compressor of high reliability.

Consequently, the invention is adopted to enable an operation even in an operating range, in which an operation is impossible because the scroll tip ends and the scroll end plates are increased in surface pressure under the operating condition of a high pressure ratio. That is, since an operating range can be enlarged with the use of the same compressor, it is possible to obtain a refrigerating apparatus and a scroll compressor, which are suited to use as a heat pump air conditioner, etc. for cold districts. Further, since the scroll tip ends can be lowered in temperature by injection, the scroll tip ends and the scroll end plates are made favorable in sliding characteristics to enable an improvement in reliability. Thus, the liquid injection is made higher in effect than the gas injection.

While the refrigerating cycles constituted as shown in FIGS. 10 and 11 are used to enable injection of the gas refrigerant or the liquid refrigerant into the compression chamber of the compressor, the scroll tip ends and the scroll end plates can be made substantially constant in surface contact pressure under any operating condition by selecting and injecting gas refrigerant or liquid refrigerant according to a load on the compressor, so that it is possible to realize a scroll compressor of high reliability.

Figure 12:
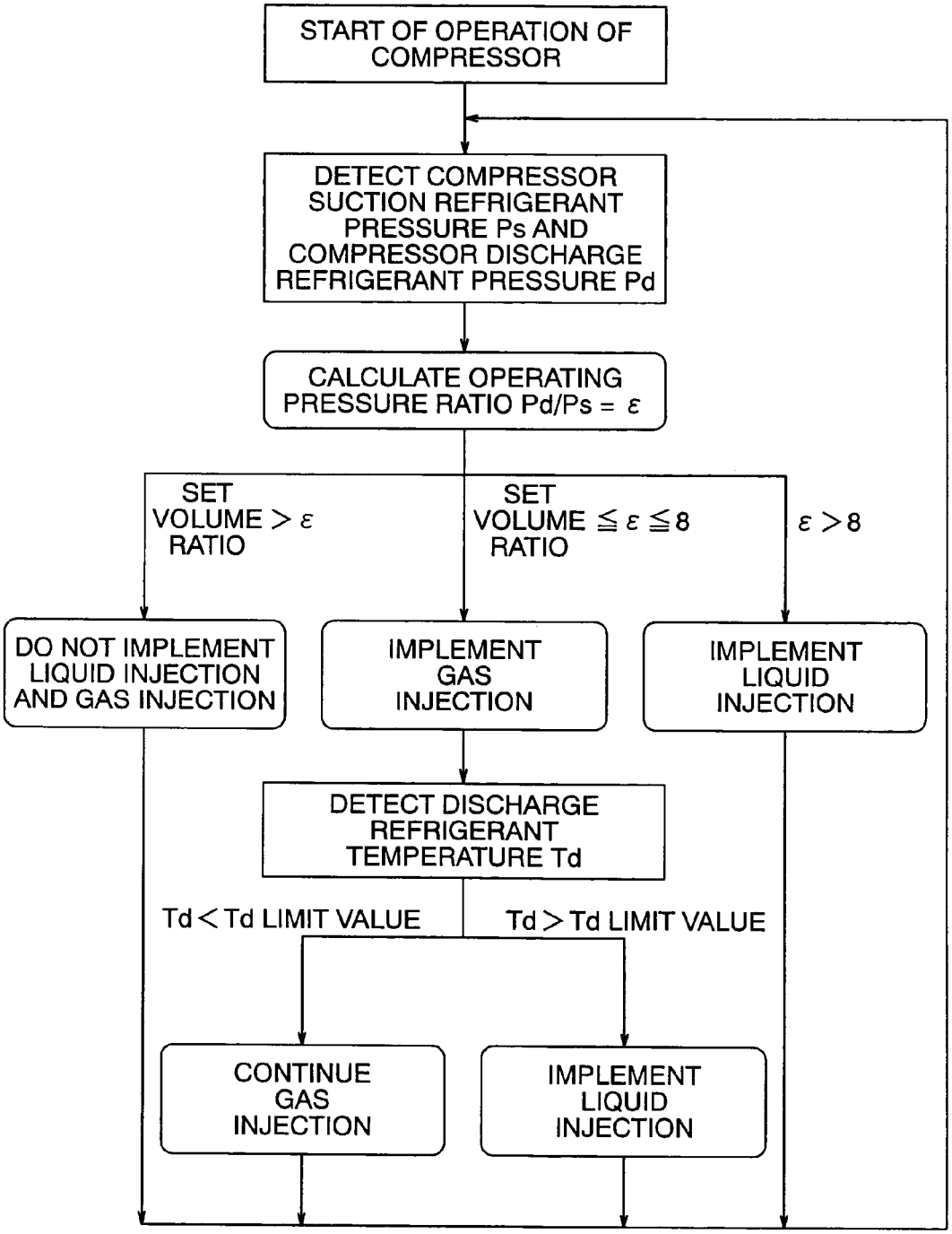
FIG. 12 is a control flowchart illustrating an example, in which a gas refrigerant or a liquid refrigerant is selected according to a load on a compressor to be injected.

Subsequently, an example of control, in which the gas refrigerant or the liquid refrigerant is selected according to a load on the compressor to be injected, will be described with reference to a control flowchart shown in FIG. 12. After the operation of the compressor is started, the suction refrigerant pressure Ps and the discharge refrigerant pressure Pd are detected by means of pressure sensors, or the like. An operating pressure ratio=Pd/Ps is calculated from the detected pressures. In this example, control is performed so that the gas injection is carried out when the operating condition of "set volume ratio $\leqq \epsilon \leqq 8$" stands, and the liquid injection is carried out when the operating condition of "$8<\epsilon$" stands. Here, the set volume ratio means a ratio of a volume (maximum volume) of the compression chamber just after the scroll compressor starts confinement and a volume (minimum volume) of the compression chamber just before communication is made to an discharge space.

While the liquid injection may be dispensed with in a compressor capable of fairly lowering the discharge gas temperature even by the gas injection, the liquid injection is preferably carried out since the discharge gas temperature cannot be generally lowered unless the liquid injection is carried out. In addition, a limit value of the discharge gas temperature is an allowable temperature of parts exposed to an atmosphere of the discharge gas within the compressor and so varied according to specifications of the compressor. In the case where an electric motor and a rolling bearing are exposed to an atmosphere of the discharge gas, the limit value of the discharge gas temperature is around 120° C. In case of $\epsilon<8$, an operating range stands, in which the discharge gas temperature can be lowered without carrying out the liquid injection, so that it is preferable to preferentially carry out the gas injection, in which a further high COP is obtained. However, in the case where the discharge gas temperature exceeds a limit value, the liquid injection is carried out.

Since pressure in the back pressure chamber, generated by the refrigerant gas, becomes small under that operating condition, in which the operating pressure ratio $\epsilon$ is smaller than a set volume ratio, there is a good possibility that when the injection causes an excessive increases in the internal pressure, a scroll is pressed toward the back pressure chamber and separation occurs between an orbiting scroll and a fixed scroll. Therefore, the control in this example is performed so that the gas injection and the liquid injection are not carried out when the operating pressure ratio $\epsilon$ is smaller than the set volume ratio.

Figure 13:
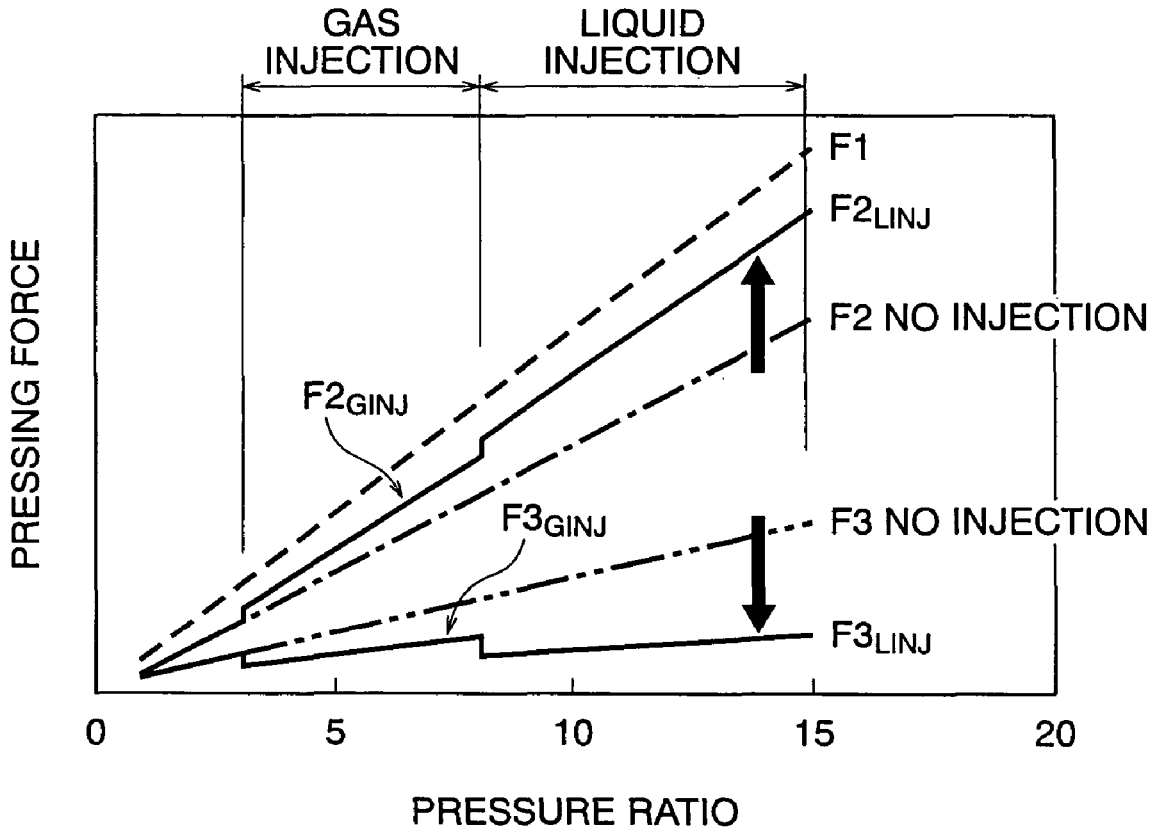
FIG. 13 is a diagram illustrating an effect produced when control illustrated in FIG. 12 is carried out, and the relationship between an operating condition (pressure ratio) and a press force.

An effect of the embodiment produced by the control shown in FIG. 12 will be described with reference to FIG. 13. FIG. 13 illustrates the relationship of the scroll pressing force with the operating pressure ratio when the control is performed to select and carry out the gas injection or the liquid injection according to the operating pressure ratio, that is, the operation load of the compressor. F1 indicates a force generated by pressure in the back pressure chamber to press the scroll, F2 indicates a force generated by the internal pressure to tend to cause separation of the scrolls when no injection is carried out, and F3 indicates a net pressing force (=F1−F2). $F2^{GINJ}$ indicates a separating force generated by the internal pressure when the gas injection is carried out, $F2^{LINJ}$ indicates a separating force generated by the internal pressure when the liquid injection is carried out, $F3^{GINJ}$ indicates a net pressing force when the gas injection is carried out, and $F3_{LINJ}$ indicates a net pressing force when the liquid injection is carried out.

As seen from the drawing, when the gas injection or the liquid injection is used properly according to the operating pressure ratio, the net force for both scrolls can be made smaller as compared with the case where no injection is carried out, and variation in the net force can be made smaller in width in contrast to a change in the operating pressure ratio. Accordingly, according to the invention, it is possible to obtain a scroll compressor, which can maintain a contact surface pressure between the scroll tip ends and the scroll end plates substantially constant and is high in reliability.

Figure 1:
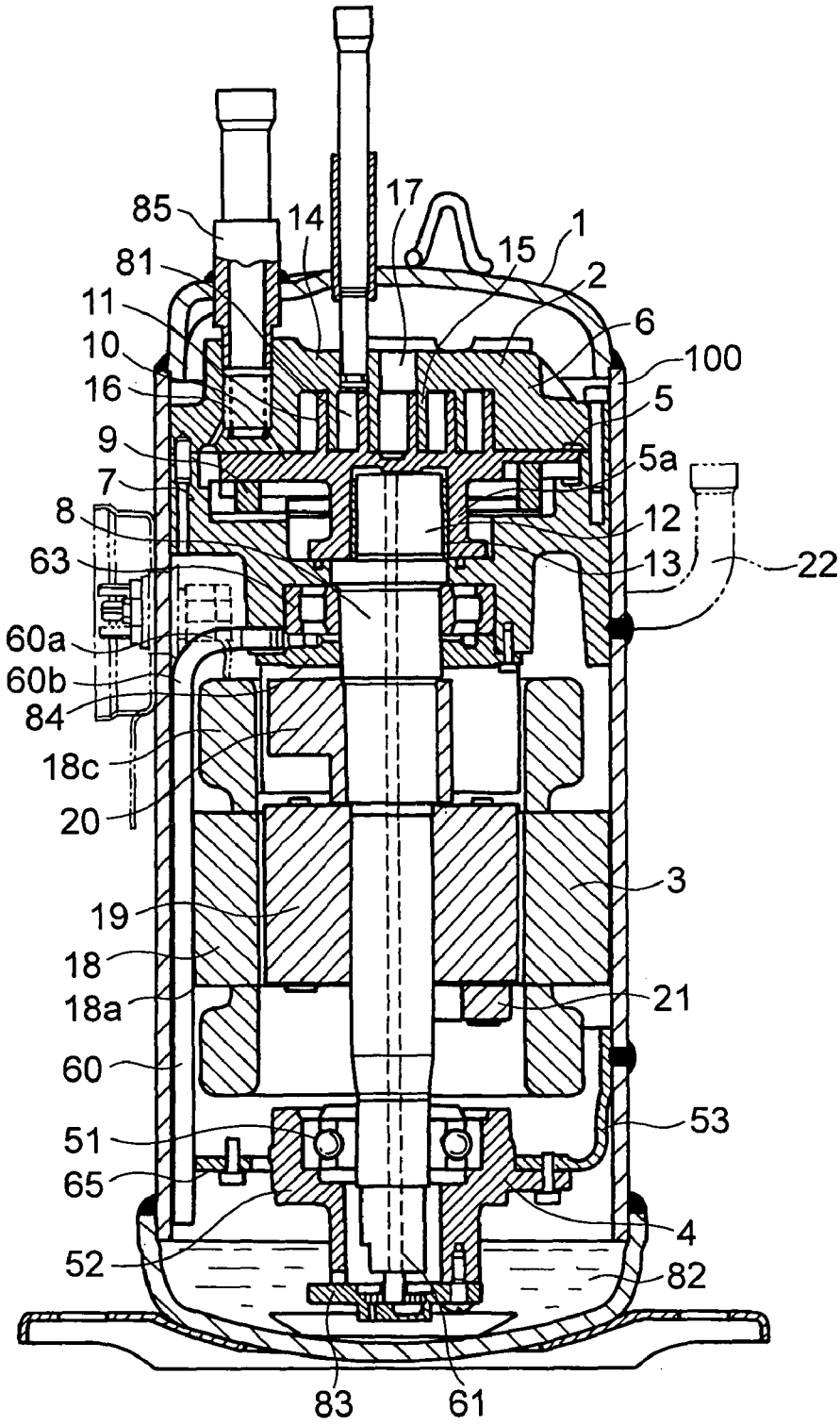
FIG. 1 is a vertical, cross sectional view of an embodiment of a scroll compressor according to the invention.

FIG. 1 shows an embodiment of a scroll compressor according to the invention.

The scroll compressor 1 is constructed to receive a compression mechanism 2, an electric motor unit 3, a subsidiary bearing unit 4, a lubrication mechanism, etc. in a closed vessel 100. The embodiment exemplifies a vertical type scroll compressor, in which the compression mechanism 2 and the electric motor unit 3 are arranged vertically.

The compression mechanism 2 comprises an orbiting scroll 5, a fixed scroll 6, a frame 7, a drive shaft 8, an bearing 13, an orbiting mechanism 9, etc. Further, the compression mechanism 2 has the fixed scroll 6 and the orbiting scroll 5 meshing with each other to define compression chambers 81.

The orbiting scroll 5 comprises an end plate 10, a spiral wrap 11 provided upright on and perpendicular to one side of the end plate, a shaft support (boss) 5*a*, etc. The orbiting mechanism (Oldham's ring) 9 and the bearing 13, into which a crank portion 12 of the drive shaft 8 is inserted, are provided on a back surface side of the end plate 10 of the orbiting scroll 5.

The fixed scroll 6 comprises an end plate 14, a spiral wrap 15 provided upright on and perpendicular to one side of the end plate, a suction port 16, a discharge port 17, etc., and is fixed to the frame 7 by means of bolts. The orbiting scroll 5 is interposed between the fixed scroll 6 and the frame 7 to enable an orbiting movement. A suction pipe 85 provided on the closed vessel 100 is connected to the suction port 16 of the fixed scroll 6. Further, a discharge pipe 22 communicated to a space between the frame 7 and the electric motor 3 is provided on the closed vessel 100.

The frame 7 is fixed at its outer periphery to the closed vessel 100 and provided at a center thereof with a main bearing 63, and the main bearing 63 is covered by the frame 7 and a cover 84. The cover 84 is detachably mounted to the frame in a manner to hold the main bearing 63 from under, and the main bearing 63 is arranged between the electric motor unit 3 and the orbiting scroll 5.

The crank portion 12 is provided on a spindle upper portion of the drive shaft 8, and the orbiting scroll 5 is driven by connection of the crank portion 12 to the scroll 5. The crank portion 12 is inserted into the bearing 13 to journal the orbiting scroll 5.

The electric motor unit 3 constitutes rotary drive means that drives the compression mechanism 2 through the drive shaft 8, and comprises a stator 18 and a rotor 19 as fundamental elements. The stator 18 is mounted to the closed vessel 100. An outer peripheral surface of the stator 18 is formed in substantially closely contact with an inner peripheral surface of the closed vessel 100.

The subsidiary bearing unit 4 supports the drive shaft 8 below the electric motor unit 3 and comprises a subsidiary bearing 51, a subsidiary bearing housing 52, into which the subsidiary bearing 51 is inserted, a lower frame 53 fixed to the subsidiary bearing housing 52, etc. and the lower frame 53 is fixed to the closed vessel 100. The drive shaft 8 is journalled on both sides of the electric motor unit 3 by the main bearing 63 and the subsidiary bearing 51 to drive the orbiting scroll through the bearing 13 by the crank portion 12 on an upper end thereof.

More specifically, when the electric motor unit 3 is rotated to rotate the drive shaft 8, the orbiting scroll 5 makes an orbiting movement relative to the fixed scroll 6 while being maintained in posture by the action of the orbiting mechanism 9. In order to cancel an unbalanced force generated by the orbiting movement, a balance weight 20 is mounted between the rotor 19 and the orbiting scroll 5 and a rotor balance weight 21 is mounted to the rotor 19.

The compression chambers 81 formed by having the fixed scroll 6 and the orbiting scroll 5 meshing with each other perform compression action, in which volumes thereof are reduced, owing to the orbiting movement of the orbiting scroll 5. In the compression action, working fluid is sucked into the compression chamber 81 from the suction port 16 with the orbiting movement of the orbiting scroll 5, and the sucked working fluid experiences a compression process to be discharged into a discharge space in the closed vessel 100 from the discharge port 17 of the fixed scroll 6 to be discharged outside the closed vessel 100 via a chamber on an electric motor side from the discharge pipe 22. Thereby, a space in the closed vessel 100 is maintained at discharge pressure.

The lubrication mechanism comprises a lubrication pump 83, a lubrication hole 61, and a scavenge pipe 60, and the lubrication pump 83 supplies lubricating oil, which is stored in an oil reservoir 82, to the subsidiary bearing 51, the bearing 13, and the main bearing 63 through the lubrication hole 61. In addition, the lubricating oil supplied to the respective bearing parts from the lubrication hole 61 also flows to sliding portions of the orbiting scroll 5 and the fixed scroll 6. A transverse lubrication hole communicated to the lubrication hole 61 is provided in the vicinity of the subsidiary bearing 51 of the drive shaft 8 to feed the lubricating oil to the subsidiary bearing 51.

The scavenge pipe 60 leads the lubricating oil, which has lubricated the main bearing 63, to the oil reservoir 82 of the closed vessel 100 through a recess 18*a* on an outer periphery of a stator of the electric motor unit 3. An end of the horizontal portion 60*a* of the scavenge pipe 60 is press fitted into and mounted to a circular hole on that portion of the frame 7, which covers the main bearing 63. The mount construction makes it possible to readily and surely mount the scavenge pipe 60 to the frame 7. A mount of the scavenge pipe 60 is opened into the frame 7, and the lubricating oil, which has lubricated the main bearing 63, is introduced into the scavenge pipe 60 from the opening.

A vertical portion 60*b* of the scavenge pipe 60 extends vertically along an inner wall surface of the closed vessel 100 to pass between a coil end 18*c* of the stator 18 and the closed vessel 100 and through the recess 18*a* on the outer periphery of the stator to extend downward, and a lower end of the scavenge pipe 60 is fixed to a pipe holder 65 mounted to the lower frame 53.

Subsequently, a construction around the compression mechanism and a back pressure chamber will be described with reference to FIG. 4. A space (back pressure chamber 111) filled with the suction pressure and a space (back pressure chamber 112) filled with the discharge pressure are formed on a back surface of the end plate 10 of the orbiting scroll 5, and the back pressure chamber 111 of the suction pressure and the back pressure chamber 112 of the discharge pressure are sealed from each other by a sealing material 114, which is mounted in a groove 113 of the frame 7. A communication hole 110 communicated to the back pressure chamber 111 is formed in a lower region of the suction port 16 of the fixed scroll, so that the back pressure chamber 111 is put at the suction pressure. The lubricating oil put in the atmosphere of the discharge pressure in a lower region of the closed vessel 100 is fed to the back pressure chamber 112 via the lubrication pump 83 and the lubrication hole 61, and thus the back pressure chamber is filled with the lubricating oil at the discharge pressure. The sealing material 114 is structured to be pressed against the orbiting scroll by the discharge gas pressure, which is filled in a gap of the groove 113 of the frame, to seal between the back pressure chamber 111 and the back pressure chamber 112. Owing to the structure described above, the orbiting scroll is pressed against the fixed scroll by the summation of the suction gas pressure in the back pressure chamber 111 and the discharge gas pressure in the back pressure chamber 112.

An injection hole 205 is formed on the end plate 14 of the fixed scroll 6 to be communicated to the compression chamber 81. A range communicated to the compression chamber 81 can be adjusted according to a position, in which the injection hole 205 is formed.

Figure 4:
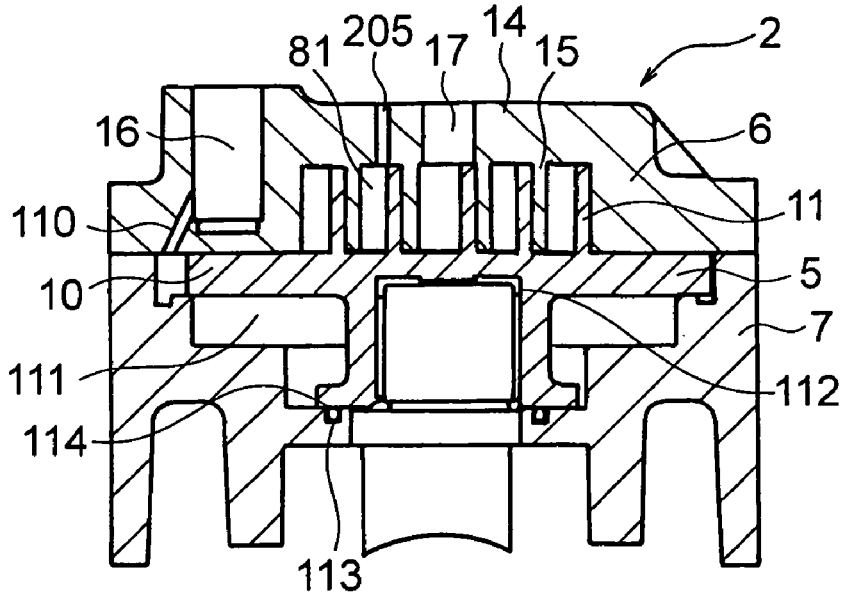
FIG. 4 is a cross sectional view showing, in an enlarged scale, an essential part of a construction around a compression mechanism and a back pressure chamber in FIG. 1 and showing a first embodiment of the invention.
Figure 5:
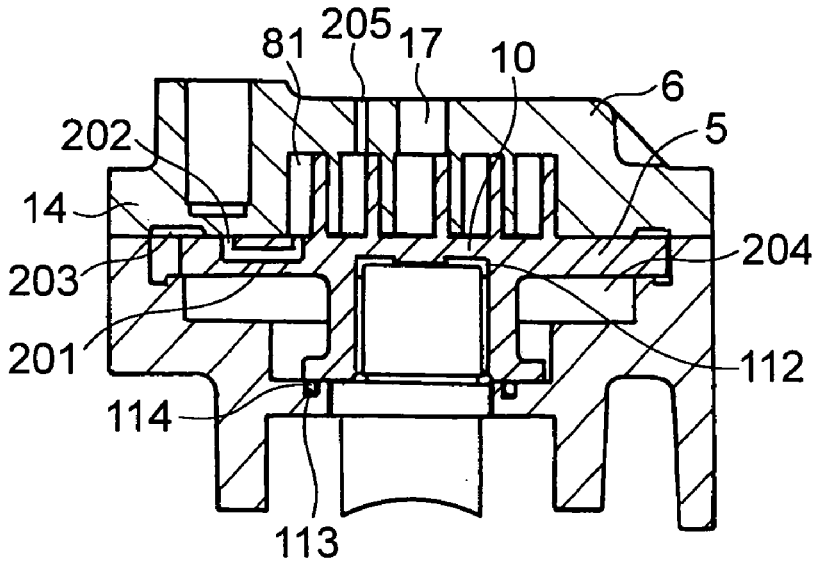
FIG. 5 is a view showing a second embodiment of the invention and corresponding to FIG. 4.

FIG. 5 shows another embodiment different from that shown in FIG. 4, and this embodiment comprises a space (back pressure chamber 204) filled with an intermediate gas pressure and the space (back pressure chamber 112) filled with the discharge gas pressure. Like the example shown in FIG. 4, according to the present embodiment, the back pressure chamber 204 of the intermediate pressure and the back pressure chamber 112 of the discharge pressure are sealed from each other by the sealing material 114.

A C-shaped communication hole (intermediate pressure hole) 201 communicated to a wrap side is formed on an end plate 10 of the orbiting scroll 5. A notch groove 203 is formed on a lower surface of an outer peripheral portion of the end plate 14 of the fixed scroll so as to be intermittently communicated to an outlet 202 on an outer peripheral side of the C-shaped communication hole 201, so that the outlet 202 is intermittently communicated to the notch groove 203 upon orbiting movement of the orbiting scroll 5. Thereby, the compression chamber 81 at the intermediate pressure is intermittently communicated to the back pressure chamber 204, so that the back pressure chamber 204 is filled with the gas at the intermediate pressure. By appropriately setting the shapes and the relationship of the C-shaped communication hole 201, the outlet 202 of the communication hole, and the notch groove 203, it is possible to adjust a range, in which the compression chamber 81 and the back pressure chamber 204 are communicated to each other, thus enabling setting the back pressure chamber 204 at an appropriate intermediate pressure.

Figure 6:
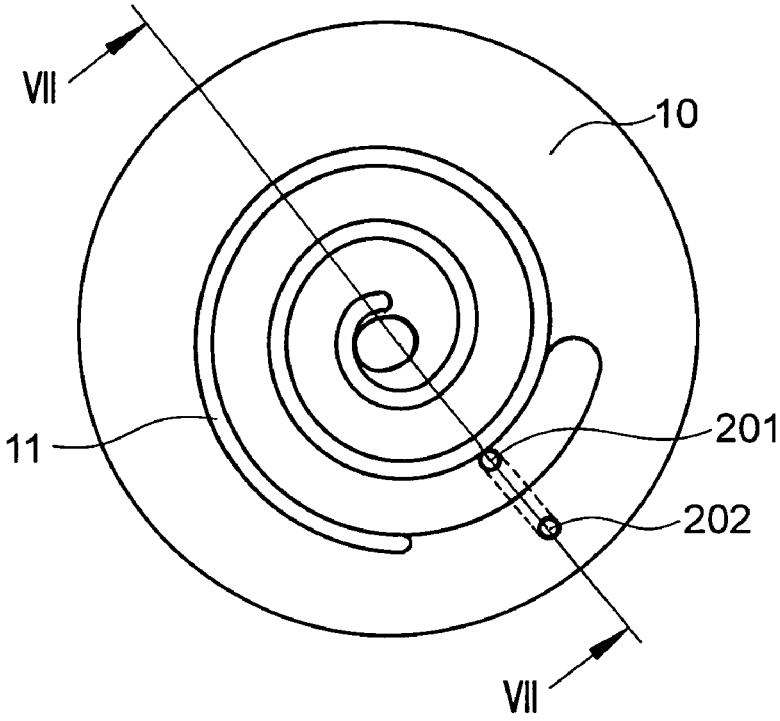
FIG. 6 is a plan view showing a detailed structure of an orbiting scroll shown in FIG. 5.
Figure 7:
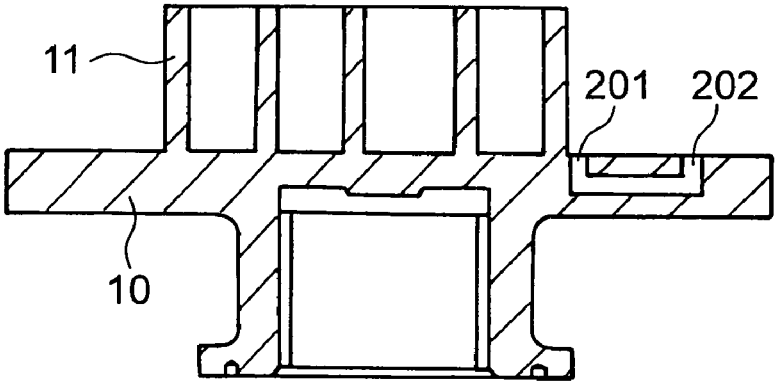
FIG. 7 is a vertical, cross sectional view taken along a line VII-VII in FIG. 6.
Figure 8:
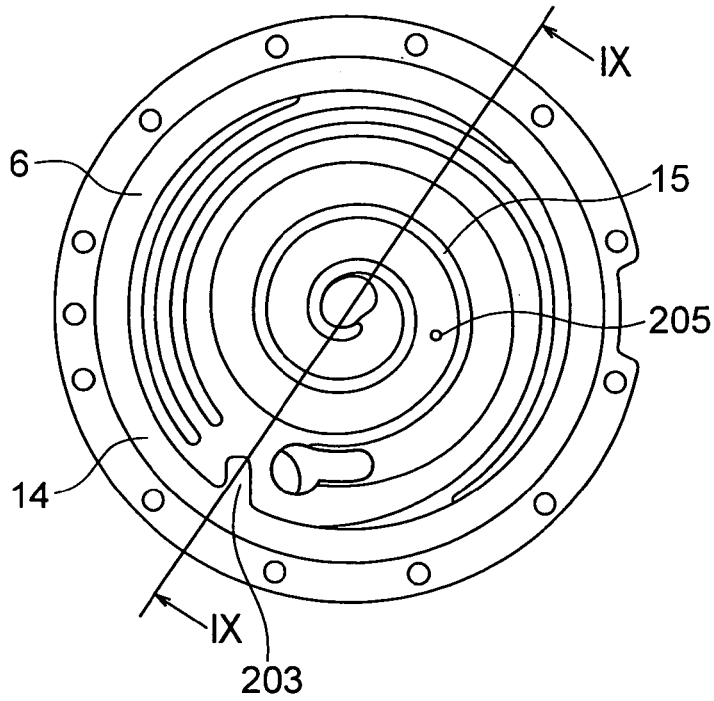
FIG. 8 is a plan view showing a detailed structure of a fixed scroll shown in FIG. 5.
Figure 9:
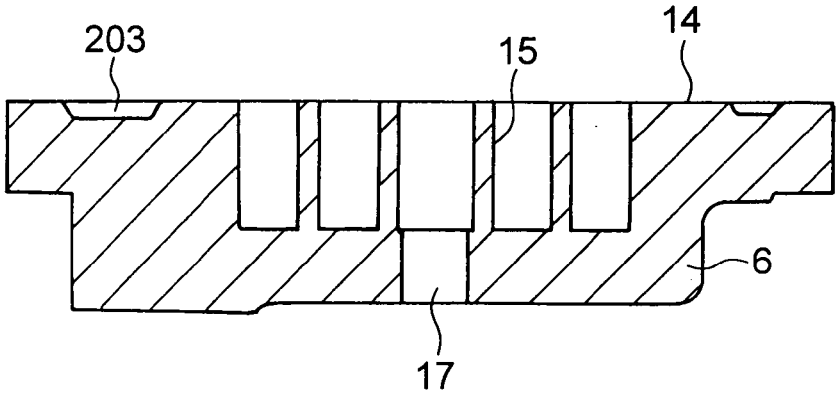
FIG. 9 is a vertical, cross sectional view taken along a line IX-IX in FIG. 8.

FIGS. 6 and 7 show a detailed structure of the orbiting scroll in the embodiment, and FIGS. 8 and 9 show a detailed structure of the fixed scroll. In these drawings, parts denoted by the same reference numerals indicate the same parts.

Figure 3:
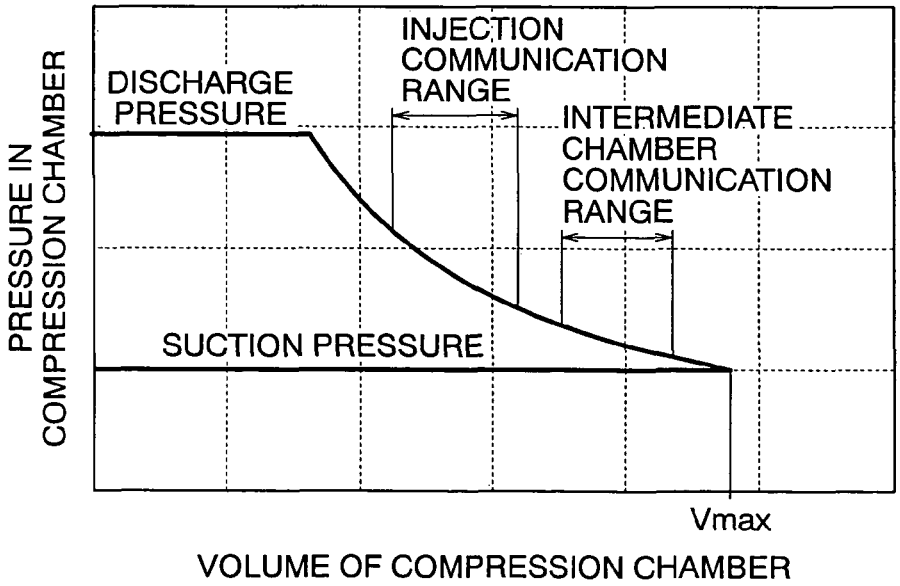
FIG. 3 is a diagram illustrating a change in internal pressure in a compression chamber, a range of communication of an intermediate pressure hole, and a range of communication of an injection hole in an embodiment of the invention.

FIG. 3 shows an example of a change in the internal pressure in the compression chamber, a communication range of the intermediate pressure hole 201, and a communication range of the injection hole 205 in the scroll compressor according to the present embodiment. As shown in the drawing, the intermediate pressure hole 201 and the injection hole 205 are set in position so that the range, in which the injection hole 205 is communicated to the compression chamber, and the range, in which the intermediate pressure hole (communication hole) 201 is communicated to the compression chamber, are positionally related to each other not so as to overlap each other. Further, positions of the injection hole 205 and the intermediate pressure hole 201 are determined so that the compression chamber, to which the injection hole 205 is communicated, is not put at the discharge pressure and besides the back pressure chamber 204 of the intermediate pressure is not put at the suction pressure, and thus the intermediate pressure chamber 204 is prevented from being influenced by pressures of liquid injection and gas injection.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll compressor comprising a compression mechanism composed of a fixed scroll, an orbiting scroll and a drive unit that drives the compression mechanism, the compression mechanism and the drive unit being accommodated in a closed vessel, one of the scrolls being provided on a back surface thereof with a back pressure chamber filled with gas refrigerant, the one of the scrolls being pressed against the other of the scrolls by pressure of the gas refrigerant in the back pressure chamber, the scroll compressor being used in a refrigerating cycle, which includes a condenser and an evaporator, wherein the back pressure chamber is composed of a space of suction pressure and a space of discharge pressure, the summation of the suction pressure and the discharge pressure pressing the one of the scrolls against the other of the scrolls, a compression chamber defined by the fixed scroll and the orbiting scroll is constructed to enable injection of both of gas refrigerant and liquid refrigerant there into from downstream of the condenser of the refrigerating cycle, and the scroll compressor further comprising a controller that controls injection of gas refrigerant into the compression chamber such that injection of gas refrigerant into the compression chamber is performed when a ratio (Pd/Ps) of the suction pressure Ps of the refrigerant sucked into the compressor and the discharge pressure Pd of the refrigerant discharged from the compressor is larger than a set volume ratio of the compressor and smaller than a predetermined value, the predetermined value being larger than the set volume ratio, and injection of liquid refrigerant into the compression chamber is performed when the ratio (Pd/Ps) is larger than the predetermined value, the set volume ratio being a ratio of a volume of the compression chamber when the orbiting scroll is at a position just after the scroll compressor starts confinement therein and a volume of the compression chamber when the orbiting scroll is at a position just before communication is made to a discharge space.

2. A scroll compressor according to claim 1, wherein an injection hole for the gas refrigerant injection or the liquid refrigerant injection is formed on the fixed scroll.

3. A scroll compressor according to claim 1, wherein a sealing material seals between the space of the suction pressure and the space of the discharge pressure in the back pressure chamber.

4. A scroll compressor comprising a compression mechanism composed of a fixed scroll, an orbiting scroll and a drive unit that drives the compression mechanism, the compression mechanism and the drive unit being accommodated in a closed vessel, one of the scrolls being provided on a back surface thereof with a back pressure chamber filled with gas refrigerant, the one of the scrolls being pressed against the other of the scrolls by pressure of the gas refrigerant in the back pressure chamber, the scroll compressor being used in a refrigerating cycle, which includes a condenser and an evaporator, wherein the back pressure chamber is composed of a space of intermediate pressure between suction pressure and discharge pressure and a space of the discharge pressure, the summation of the intermediate pressure and the discharge pressure pressing the one of the scrolls against the other of the scrolls, a compression chamber defined by the fixed scroll and the orbiting scroll is constructed to enable injection of both of gas refrigerant and liquid refrigerant there into from downstream of the condenser of the refrigerating cycle, and the scroll compressor further comprising a controller that controls injection of gas refrigerant into the compression chamber such that injection of gas refrigerant into the compression chamber is performed when a ratio (Pd/Ps) of the suction pressure Ps of the refrigerant sucked into the compressor and the discharge pressure Pd of the refrigerant discharged from the compressor is larger than a set volume ratio of the compressor and smaller than an a predetermined value, the predetermined value being larger than the set volume ratio, and injection of liquid refrigerant into the compression chamber is performed when the ratio (Pd/Ps) is larger than the predetermined value, the set volume ratio being a ratio of a volume of the compression chamber when the orbiting scroll is at a position just after the scroll compressor starts confinement therein and a volume of the compression chamber when the orbiting scroll is at a position just before communication is made to a discharge space.

5. A scroll compressor according to claim 4, further comprising an intermediate pressure hole provided on an end plate, on which pressure of the back pressure chamber acts, to provide communication between the space of the back pressure chamber in the intermediate pressure and the compression chamber, and an injection hole formed on an end plate of the fixed scroll to allow the gas refrigerant injection or the liquid refrigerant injection.

6. A scroll compressor according to claim 5, wherein the injection hole is formed so as to be communicated to a compression chamber on a higher pressure side than that of the compression chamber, to which the intermediate pressure hole is communicated.

7. A scroll compressor according to claim 6, wherein the intermediate pressure hole and the injection hole are formed so that a range, in which the intermediate pressure hole is opened to the compression chamber, and a range, in which the injection hole is opened to the compression chamber, do not overlap each other.

8. A scroll compressor according to claim 7, wherein the injection hole is provided in a position not directly connected to discharge space of the compressor.

9. A scroll compressor according to claim 7, wherein the intermediate pressure hole is provided in a position not communicated to suction space of the compressor.

10. A scroll compressor according to claim 4, wherein a sealing material seals between the space of the intermediate pressure and the space of the discharge pressure in the back pressure chamber.

11. A scroll compressor according to claim 3, wherein an area ratio S1/S2 of an area S1 of an end plate of the scroll, which bears the suction pressure or the intermediate pressure in the back pressure chamber, and an area S2 of the end plate of the scroll, which bears the discharge pressure, is less than 5.

12. A scroll compressor according to claim 10, wherein an area ratio S1/S2 of an area S1 of an end plate of the scroll, which bears the suction pressure or the intermediate pressure in the back pressure chamber, and an area S2 of the end plate of the scroll, which bears the discharge pressure, is less than 5.

13. A scroll compressor according to claim 1, wherein the gas refrigerant or the liquid refrigerant is injected into the compression chamber where there stands an operating condition, in which a ratio (Pd/Ps) of suction pressure Ps of the refrigerant and a discharge pressure Pd of the refrigerant exceeds 3.

14. A scroll compressor according to claim 4, wherein the gas refrigerant or the liquid refrigerant is injected into the compression chamber where there stands an operating condition, in which a ratio (Pd/Ps) of suction pressure Ps of the refrigerant and a discharge pressure Pd of the refrigerant exceeds 3.

15. A scroll compressor according to claim 13, wherein the liquid refrigerant is injected into the compression chamber when there stands an operating condition, in which the ratio (Pd/Ps) of the suction pressure Ps of the refrigerant and the discharge pressure Pd of the refrigerant exceeds 8.

16. A scroll compressor according to claim 14, wherein the liquid refrigerant is injected into the compression chamber when there stands an operating condition, in which the ratio (Pd/Ps) of the suction pressure Ps of the refrigerant and the discharge pressure Pd of the refrigerant exceeds 8.

* * * * *